US010299980B2

(12) United States Patent
Ban et al.

(10) Patent No.: US 10,299,980 B2
(45) Date of Patent: May 28, 2019

(54) REHABILITATION EXERCISE DEVICE

(71) Applicant: NEOFECT CO., LTD., Seongnam-si, Gyeonggi-do (KR)

(72) Inventors: Hoyoung Ban, Yongin-si (KR); Younggeun Choi, Yongin-si (KR); Soobin Lee, Seongnam-si (KR); Kyunghwan Yoo, Incheon (KR); SungJun Roh, Seoul (KR); Hoyeong Song, Yongin-si (KR)

(73) Assignee: NEOFECT CO., LTD., Seongnam-si (KR)

( * ) Notice: Subject to any disclaimer, the term of this patent is extended or adjusted under 35 U.S.C. 154(b) by 247 days.

(21) Appl. No.: 15/030,373

(22) PCT Filed: Jun. 16, 2015

(86) PCT No.: PCT/KR2015/006071
§ 371 (c)(1),
(2) Date: Apr. 18, 2016

(87) PCT Pub. No.: WO2016/204319
PCT Pub. Date: Dec. 22, 2016

(65) Prior Publication Data

US 2017/0165144 A1 Jun. 15, 2017

(30) Foreign Application Priority Data

Jun. 15, 2015 (KR) ..... 10-2015-0084136

(51) Int. Cl.
*A61H 1/02* (2006.01)
*A63B 23/12* (2006.01)
(Continued)

(52) U.S. Cl.
CPC ..... *A61H 1/0281* (2013.01); *A61H 1/0285* (2013.01); *A63B 21/0618* (2013.01);
(Continued)

(58) Field of Classification Search
CPC ..... A61H 1/00; A61H 1/0281; A61H 1/0285; G05G 9/047; A63H 17/00; A63H 33/005; A63B 23/12
(Continued)

(56) References Cited

U.S. PATENT DOCUMENTS 2,749,660 A * 6/1956 Zimentstark ..... A63H 29/18 446/459
3,564,765 A * 2/1971 Stormon et al. ..... A63H 17/36 446/454
(Continued)

FOREIGN PATENT DOCUMENTS

JP 2007-185325 A 7/2007
JP 2015-66379 A 4/2015
(Continued)

OTHER PUBLICATIONS

Automated Translation of Masaru et al., JP 2015066379, Rehabilitation Device for Thoracic Limb.*
(Continued)

*Primary Examiner* — Michael J Tsai
*Assistant Examiner* — Christopher E Miller
(74) *Attorney, Agent, or Firm* — Studebaker & Brackett PC

(57) ABSTRACT

A mouse-type rehabilitation exercise device includes a mouse body on which a hand is mounted, a wheel moving the mouse body, a first motor aligning a position of the wheel such that the mouse body moves to a desired direction, a second motor rotating the wheel such that the wheel aligned by the first motor moves to a desired position, a clutch disposed between the second motor and the wheel to enable and disable a power transmitting to the wheel from the second motor, and a controller controlling a driving of the first motor, the second motor, and the clutch.

11 Claims, 6 Drawing Sheets

(51) Int. Cl.

| | |
|---|---|
| ***A63B 23/14*** | (2006.01) |
| ***A63B 21/00*** | (2006.01) |
| ***A63B 21/06*** | (2006.01) |
| ***A63B 21/22*** | (2006.01) |
| ***A63B 24/00*** | (2006.01) |
| *A63B 21/005* | (2006.01) |
| *A63B 22/20* | (2006.01) |
| *A63B 23/035* | (2006.01) |

(52) U.S. Cl.
CPC ..... *A63B 21/22* (2013.01); *A63B 21/4035* (2015.10); *A63B 21/4049* (2015.10); *A63B 23/1245* (2013.01); *A63B 23/14* (2013.01); *A63B 24/0087* (2013.01); *A61H 2201/1207* (2013.01); *A61H 2201/1445* (2013.01); *A61H 2201/1472* (2013.01); *A61H 2201/1635* (2013.01); *A61H 2201/1671* (2013.01); *A61H 2201/50* (2013.01); *A61H 2201/5035* (2013.01); *A61H 2201/5058* (2013.01); *A61H 2201/5092* (2013.01); *A63B 21/0058* (2013.01); *A63B 21/157* (2013.01); *A63B 22/20* (2013.01); *A63B 23/03508* (2013.01); *A63B 23/1209* (2013.01); *A63B 2213/00* (2013.01)

(58) Field of Classification Search
USPC ..... 345/163; 446/454, 456, 460, 465, 90; 180/252–253
See application file for complete search history.

(56) References Cited

U.S. PATENT DOCUMENTS 3,648,796 A * 3/1972 Gamundi ..... B60S 9/215 180/119
3,753,313 A * 8/1973 Bross ..... A63H 17/36 446/451
4,540,380 A * 9/1985 Kennedy ..... A63H 31/08 105/119
5,454,774 A * 10/1995 Davis ..... A63B 22/18 434/258
5,466,213 A * 11/1995 Hogan ..... A61H 1/02 482/4
5,609,220 A * 3/1997 Moriya ..... B62D 7/08 180/253
5,692,946 A * 12/1997 Ku ..... A63H 33/005 446/456
5,739,811 A * 4/1998 Rosenberg ..... A63F 13/06 345/161
5,901,805 A * 5/1999 Murakami ..... B62D 1/28 180/168
5,924,512 A * 7/1999 Wada ..... B62D 1/28 180/23
5,984,880 A * 11/1999 Lander ..... G09B 23/28 600/595
6,477,448 B1 * 11/2002 Maruyama ..... B25J 13/02 318/568.11
6,491,127 B1 * 12/2002 Holmberg ..... B60K 7/0007 180/21
6,613,000 B1 * 9/2003 Reinkensmeyer ..... A61B 5/221 600/587
7,418,328 B2 * 8/2008 Romig ..... A01D 34/008 180/253
7,654,350 B2 * 2/2010 Manken ..... B60K 7/0007 180/253
8,142,254 B1 * 3/2012 Greenley ..... A63H 29/22 446/431
8,348,002 B2 * 1/2013 Checketts ..... B60K 7/0007 180/200
8,424,627 B2 * 4/2013 Kuo ..... B60K 7/0007 180/253
9,764,191 B2 * 9/2017 Oshima ..... A61B 5/221
2001/0051489 A1 * 12/2001 Gu ..... B62K 9/00 446/465
2003/0127259 A1 * 7/2003 Logstrup ..... B62B 5/02 180/23
2006/0106326 A1 * 5/2006 Krebs ..... A61H 1/0274 601/40
2008/0280527 A1 * 11/2008 Sato ..... A63H 17/26 446/448
2010/0179453 A1 * 7/2010 Schweighofer ..... A61B 5/1118 600/595
2011/0015842 A1 * 1/2011 Kume ..... B62B 5/0026 701/67
2011/0112441 A1 * 5/2011 Burdea ..... A63B 21/06 600/595
2013/0012362 A1 * 1/2013 Ju ..... A61H 1/0285 482/49
2013/0288560 A1 * 10/2013 Abou-Hamda ..... A63H 33/005 446/175
2014/0200432 A1 * 7/2014 Banerji ..... A61B 5/0488 600/383
2015/0359697 A1 * 12/2015 Celik ..... A61H 1/0285 601/33
2017/0132947 A1 * 5/2017 Maeda ..... A61H 1/02

FOREIGN PATENT DOCUMENTS

| | | | |
|---|---|---|---|
| JP | 2015-066379 | A | 4/2015 |
| KR | 10-0723433 | B1 | 5/2007 |
| KR | 10-1099063 | B1 | 12/2011 |
| KR | 10-1264560 | B1 | 5/2013 |
| KR | 10-1317906 | B1 | 10/2013 |
| KR | 10-1613505 | B1 | 5/2016 |

OTHER PUBLICATIONS

Notice of Allowance dated Sep. 22, 2016 corresponding to Korean Application No. 10-2015-0084136, citing the above reference(s).
Korean Office Action dated Jun. 29, 2016 corresponding to Korean Application No. 10-2015-0084136.
International Search Report for PCT/KR2015/006071 dated Dec. 14, 2015, citing the above reference(s).

* cited by examiner

REHABILITATION EXERCISE DEVICE

CROSS REFERENCE TO RELATED APPLICATION

This application claims the priority of Korean Patent Application No. 10-2015-0084136 filed Jun. 15, 2015 in the KIPO (Korean Intellectual Property Office). Further, this application is the National Phase application of International Application No. PCT/KR2015/006071 filed Jun. 16, 2015, which designates the United States and was published in Korean.

TECHNICAL FIELD

The present invention relates to a mouse-type rehabilitation exercise device, and more particularly, to a mouse-type rehabilitation exercise device capable of being used in rehabilitation of a joint of wrist and/or shoulder.

BACKGROUND ART

In general, each of the joints of human body has a structure in which adjacent parts of the joint are able to move/rotate relative to the joint.

Meanwhile, people having weak muscles, such as the elderly or patients in rehabilitation, find difficulty in moving their joints freely compared with the people in good health, and even though they are in need of exercise, it is difficult for them to exercise using existing exercise equipments in reality.

Especially, since patients who underwent wrist and/or shoulder surgery are difficult to exercise by themselves, joints at wrist and/or shoulder become stiff due to muscle weakening, poor nutrition circulation, etc.

In order to prevent joint deformities and to return to daily activities, they need to perform rehabilitation exercises, which accompany pain, for a long time.

Meanwhile, lots of conventional rehabilitation exercise devices have a function that restricts the movement of joint angle of the wrist and/or shoulder to prevent excessive exercise.

In recent, a rehabilitation exercise device for varying the joint angle by an actuator has been studied.

Accordingly, the applicants have developed a mouse-type rehabilitation exercise device for wrist and/or shoulder joints rehabilitation while the user mounts his/her hand on the mouse-type rehabilitation exercise device.

DETAILED DESCRIPTION OF THE INVENTION

Technical Problem

The present invention provides a mouse-type rehabilitation exercise device having a compact size and moving a mouse body, on which a hand is mounted, through various patterns in accordance with a user's characteristics to vary a joint angle of wrist and/or shoulder for rehabilitation exercises.

In addition, the present invention provides a mouse-type rehabilitation exercise device allowing the user to move the mouse body to a desired direction using a fine muscle strength and to vary the joint angle of wrist and/or shoulder for rehabilitation exercises.

Technical Solution

A mouse-type rehabilitation exercise device according to an embodiment of the present invention includes a mouse body on which a hand is mounted, a wheel moving the mouse body, a first motor aligning a position of the wheel such that the mouse body moves to a desired direction, a second motor rotating the wheel such that the wheel aligned by the first motor moves to a desired position, a clutch disposed between the second motor and the wheel to enable and disable a power transmitting to the wheel from the second motor, and a controller controlling a driving of the first motor, the second motor, and the clutch.

The controller controls the driving of the first motor, the second motor, and the clutch in one operation mode of a first operation mode in which a direction of the wheel is aligned by the first motor and a user moves the mouse body to the desired position along a predetermined pattern as guided by his/her own strength and a second operation mode in which the direction of the wheel is aligned by the first motor and the mouse body moves to the desired position by a rotation of the second motor in accordance with the predetermined pattern.

The clutch disconnects the wheel and the second motor in the first operation mode, and the clutch connects the wheel and the second motor in the second operation mode.

The controller controls the mouse body such that the mouse body is operated in the second operation mode when the mouse body does not move to the desired position of the predetermined pattern during a predetermined time period in the first operation mode.

The mouse-type rehabilitation exercise device includes a plurality of casters disposed at the mouse body to be capable of rolling, and the casters maintain a horizontal level of the mouse body and freely change a direction of the mouse body.

The mouse-type rehabilitation exercise device includes a driving gear coupled to a shaft of the first motor and rotated, a driven gear engaged with the driving gear and rotated, and a rotating bracket supported by the driven gear and provided to the mouse body to be rotatable, the second motor is supported by one side portion of the rotating bracket, the wheel is supported by the other side portion of the rotating bracket to be capable of rolling such that the clutch is disposed between one side portion of the rotating bracket and the other side portion of the rotating bracket, and the rotating bracket is rotated by the rotation of the driven gear.

The mouse-type rehabilitation exercise device further includes a weight supported by the rotating bracket to face the second motor such that the wheel and the clutch are disposed between the weight and the second motor and to maintain a center of gravity applied to the rotating bracket.

The mouse-type rehabilitation exercise device further includes a handle protruded from the mouse body and gripped by the hand.

The handle is provided to the mouse body to be swivelable.

The controller drives the first motor to align the position of the wheel and selectively connects the wheel and the second motor by the clutch to rotate the wheel in response to an operation signal from the handle such that the mouse body moves to a direction indicated by the handle.

According to another embodiment, the controller drives the first motor to align the position of the wheel and connects the second motor and the wheel by the clutch to rotate the wheel in response to an operation signal from the handle such that the mouse body moves to a direction opposite to a direction indicated by the handle.

According to another embodiment, the controller drives the first motor to align the position of the wheel in a direction indicated by the handle and connects the second motor and the wheel by the clutch to rotate the wheel in response to an operation signal from the handle such that the mouse body moves to a direction opposite to a direction indicated by the handle.

The mouse-type rehabilitation exercise device further includes a pattern identifier disposed at the mouse body to identify coordinate data of a printed pattern printed on a printed matter. The controller controls the drive of the first motor, the second motor, and the clutch such that the mouse body moves on the basis of the coordinate data of the printed pattern identified by the pattern identifier.

The pattern identifier is an optical identification sensor or a photo-sensor.

Advantageous Effects of the Invention

According to the present invention, the mouse body moves by aligning the position of the wheel using the first motor and rotating the wheel using the second motor. Accordingly, the device may be realized in compact form, and joint exercises are performed through various patterns in accordance with a user's characteristics to vary a joint angle of wrist and/or shoulder of the user for rehabilitation exercises.

In addition, since the handle in the form of the joystick is provided to the mouse body, the user may move the mouse body to the desired direction using his/her fine muscle strength while the joint angle of wrist and/or shoulder of the user is varied for rehabilitation exercises.

MODE OF THE INVENTION

Hereinafter, the present invention will be described in detail with reference to accompanying drawings.

Figure 1:
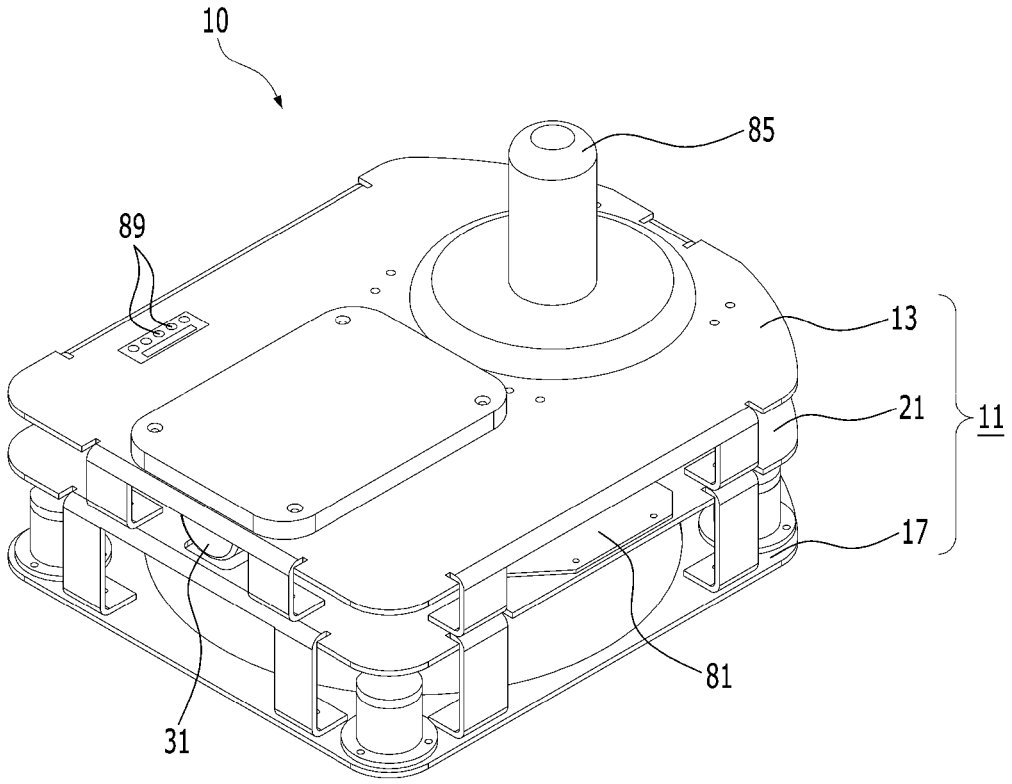
FIG. 1 shows a perspective view of a mouse-type rehabilitation exercise device according to an embodiment of the present invention.
Figure 2:
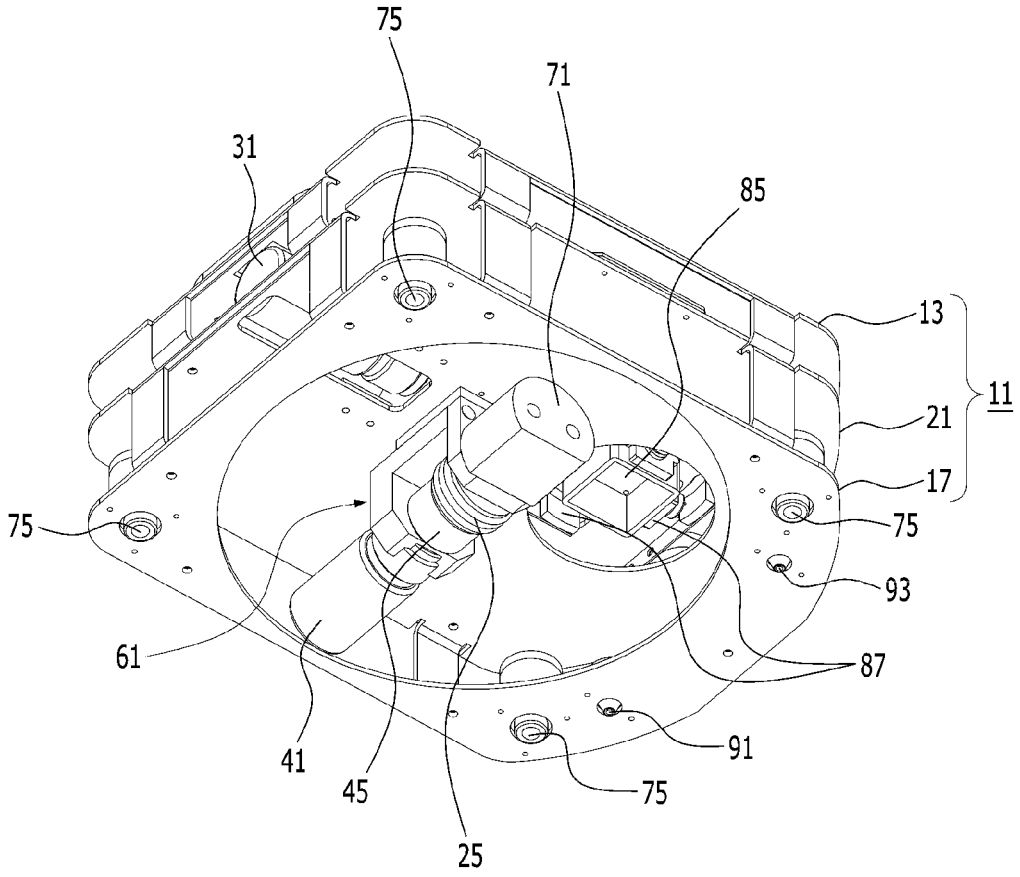
FIG. 2 shows a perspective view of a lower portion of FIG. 1.
Figure 3:
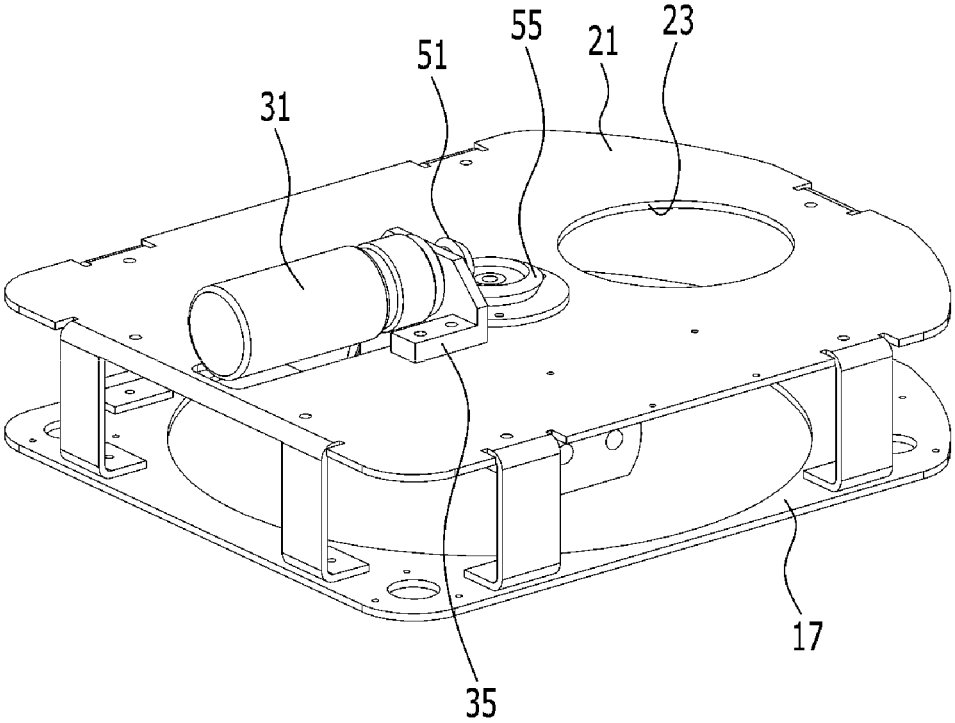
FIG. 3 shows a perspective view of FIG. 1 from which an upper frame and a handle are removed.
Figure 4:
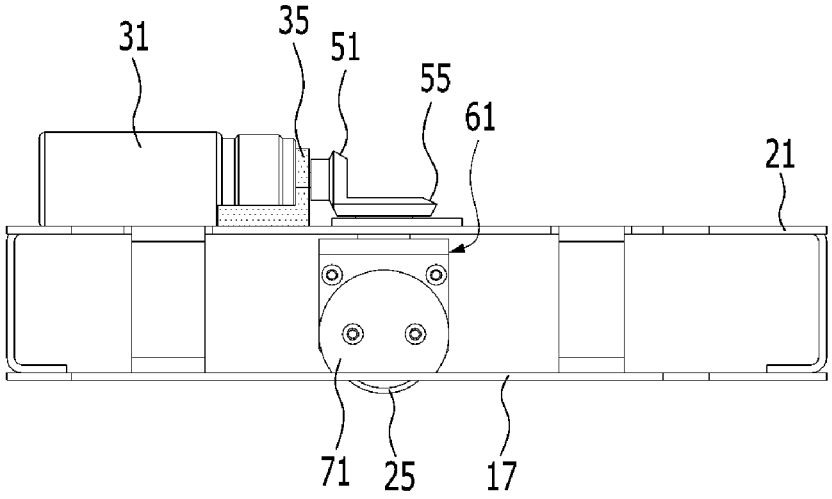
FIG. 4 shows a front view of FIG. 3.
Figure 5:
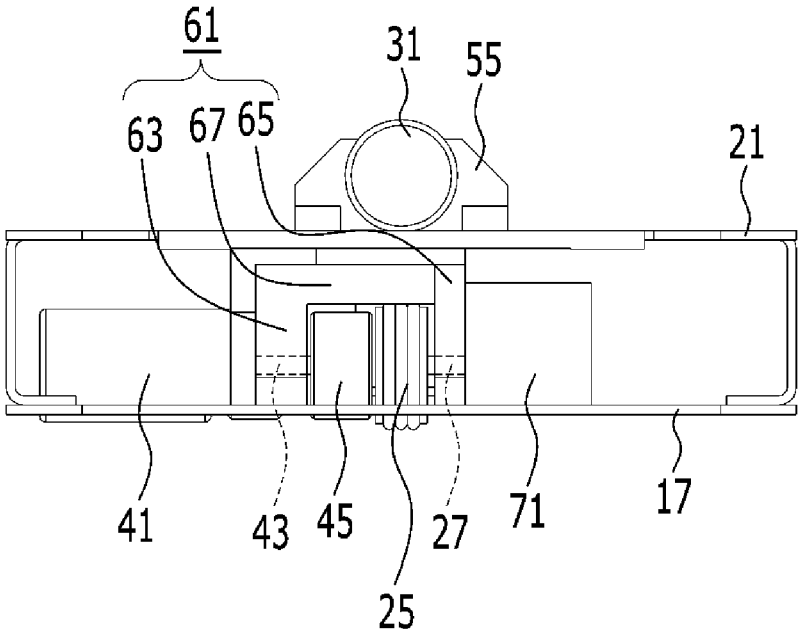
FIG. 5 shows a left side view of FIG. 3.
Figure 6:
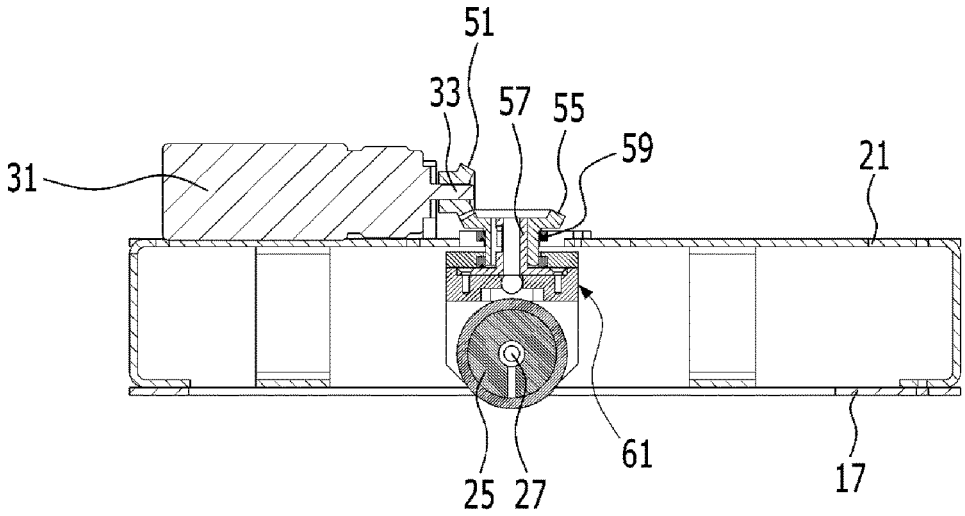
FIG. 6 shows a cross-sectional view of an essential portion of FIG. 3.

FIGS. 1 to 6 shows a mouse-type rehabilitation exercise device according to an exemplary embodiment of the present invention.

As shown in figures, the mouse-type rehabilitation exercise device 10 according to an embodiment of the present invention includes a mouse body 11, a wheel 25, a first motor 31, a second motor 41, a clutch 45, and a controller 81.

The mouse body 11 includes three frames stacked one on another to be spaced apart from each other. The mouse body 11 includes an upper frame 13 corresponding to an upper portion of the mouse body 11, on which a user's hand is placed, a lower frame 17 corresponding to a lower portion of the mouse body 11, and an intermediate frame 21 disposed between the upper frame 13 and the lower frame 17. The intermediate frame 21 includes a handle mounting hole 23 formed therethrough, and a handle 85 is mounted on the handle mounting hole 23. The first motor 31, the second mode 41, the clutch 45, and the controller 81 are accommodated in the mouse body 11.

The wheel 25 is disposed at a lower center portion of the mouse body 11 to move the mouse body 11. The wheel 25 is connected to a wheel axle 27 that will be described later such that a portion of the wheel 25 is protruded outward than the lower frame 17.

The first motor 31 is placed at the intermediate frame 21 and aligns a position of the wheel 25 to move the mouse body 11 to a desired direction. The first motor 31 is supported by a support bracket 35 disposed on the intermediate frame 21.

The second motor 31 is placed at the intermediate frame 21 and rotates the wheel 25 such that the wheel aligned by the first motor 31 moves to a desired position. The second motor 41 is supported by a rotating bracket 61 disposed under the intermediate frame 21 and described later.

The clutch 45 is disposed between the second motor 41 and the wheel 25. One end of the clutch 45 is connected to a shaft 43 of the second motor 41 and the other end of the clutch 45 is connected to the wheel axle 27 to enable and disable a power transmitting to the wheel 25 from the second motor 41. For instance, a torque of the second motor 41 is transferred to the wheel 25 by the clutch 45 or released at the clutch 45. Here, the clutch 45 may be an electrical clutch, a frictional clutch, or a fluid clutch.

Meanwhile, the mouse-type rehabilitation exercise device 10 according to an embodiment of the present invention includes a driving gear 51, a driven gear 55, and the rotating bracket 61 as a power transmission part that transfer the power to the wheel 25 from the first motor 31 and the second motor 41.

The driving gear 51 is connected to a shaft 33 of the first motor 31 and rotated by the driving of the first motor 31.

The driven gear 55 is engaged with the driving gear 51 to be rotated, and the driven gear 55 is connected to the rotating bracket 61 by a connecting bushing 57 inserted into and coupled to the driven gear 55. In addition, a bearing 59 is placed on an outer portion of the driven gear 55, and the driven gear 55 is rotatably supported by the bearing 59 while being coupled to the intermediate frame 21. Accordingly, the rotating bracket 61 is rotated by the rotation of the driven gear 55.

In the present embodiment, the driving gear 51 is perpendicularly engaged with the driven gear 55 in the form of a bevel gear.

The rotating bracket 61 is attached to the driven gear 55 by the connecting bushing 57 and includes a first support plate 63, a second support plate 65, and a connecting plate 67 connecting the first support plate 63 and the second support plate 65.

The second motor 41 is supported by the first support plate 63, the wheel axle 27 is rotatably supported by the second support plate 65, and the connecting bushing 57 is supported by the connecting plate 67.

Therefore, the rotating bracket 61 may be rotated through about 360 degrees in accordance with the rotation of the driven gear 55.

Meanwhile, the clutch 45 and the wheel 25 are disposed between the first support plate 63 and the second support plate 65.

One end of the clutch 45 is connected to the shaft 43 of the second motor 41, and the other end of the clutch 45 is connected to the wheel axle 27. The wheel 25 is placed between the clutch 45 and the second support plate 65 and coupled to the wheel axle 27.

In addition, a weight 71 is disposed on the second support plate 65 of the rotating bracket 61 to maintain a center of gravity applied to the rotating bracket 61. The weight 71 is supported by the second support plate 65 of the rotating bracket 61 to face the second motor 41 such that the wheel 25 and the clutch 45 are disposed between the weight 71 and the second motor 41.

Thus, when the rotating bracket 61 is rotated with respect to the wheel 25, the rotating bracket 61 is prevented from leaning to one side due to a weight of the second motor 41 since the weight 71 disposed at an opposite side of the second motor 41 adjusts the weight balance. Accordingly, the mouse body 11 may stably move without losing the balance.

Meanwhile, the mouse-type rehabilitation exercise device 10 according to an embodiment of the present invention includes a plurality of casters 75 that may maintain a horizontal level of the mouse body 11 and freely change a direction of the mouse body 11.

The casters 75 are disposed on the lower frame 17 of the mouse body 11 at regular intervals and protruded than the lower frame 17 to be capable of rolling. In the present embodiment, four casters 75 are provided to the lower frame 17, but the number of the casters 75 should not be limited to four. That is, one or more pairs of the casters 75 may be provided with the mouse-type rehabilitation exercise device 10.

The controller 81 of the mouse-type rehabilitation exercise device 10 according to an embodiment of the present invention is provided in the form of a circuit board and disposed on the intermediate frame 21 to control a drive of the first motor 31, the second motor 41, and the clutch 45.

The controller 81 controls the mouse body 11 such that the mouse body 11 is operated in either a first operation mode or a second operation mode.

The first operation mode is a kind of an active operation mode in which a direction of the wheel 25 is aligned by the first motor 31 and a user moves the mouse body 11 to a desired position by his/her own strength in accordance with a predetermined pattern That is, when the first operation mode is selected by a control selection button 89, the controller 81 applies a control signal to the first motor 31 to drive the first motor 31 and controls the clutch 45 such that the second motor 41 is not connected to the wheel 25. When the first motor 31 is driven, the driving gear 51 is rotated, and the driven gear 55 engaged with the driving gear 51 is rotated, thereby rotating the rotating bracket 61. Accordingly, the direction of the wheel 25 is aligned. When the direction of the wheel 25 is aligned, the user may move the mouse body 11 to the desired position by his/her own strength, and thus the user may perform the rehabilitation exercise.

Thus, the direction in which the mouse body 11 moves is determined by the first motor 31 in the first operation mode, but the movement of the mouse body 11 toward the desired position is required to be controlled by the user.

The second operation mode is a kind of a passive operation mode in which the direction of the wheel 25 is aligned by the first motor 31 and the mouse body 11 moves to the desired position by the rotation of the second motor 41 in accordance with a predetermined pattern That is, when the second operation mode is selected by the control selection button 89, the controller 81 applies the control signal to the first motor 31 to drive the first motor 31 and controls the clutch 45 such that the second motor 41 is not connected to the wheel 25. Since the first motor 31 is driven, the driving gear 51 is rotated, and the driven gear 55 engaged with the driving gear 51 is rotated, thereby rotating the rotating bracket 61. Accordingly, the direction of the wheel 25 is aligned. When the direction of the wheel 25 is aligned, the controller 81 applies a control signal to the clutch 45 to control the clutch 45 such that the second motor 41 is connected to the wheel 25 and applies a control signal to the second motor 41 to drive the second motor 41. Accordingly, the torque of the second motor 41 is transferred to the wheel through the clutch 45, and thus the wheel 25 is rotated.

Therefore, the direction in which the mouse body 11 moves is determined by the first motor 31 in the second operation mode, but the movement of the mouse body 11 is performed by the second motor 41. Thus, the user may perform the rehabilitation exercise in accordance with a pattern set by a program while the user puts their hands on the mouse body 11 regardless of the will of the user.

Meanwhile, according to the mouse-type rehabilitation exercise device 10 according to an embodiment of the present invention, the controller 81 may control the mouse body 11 such that the mouse body 11 is operated in the second operation mode in the case that the mouse body 11 does not move to the desired position of the pattern set by the program during a predetermined time period within the first operation mode.

That is, when the controller 81 determines that the mouse body 11 does not move to the desired position of the pattern set by the program during the predetermined time period while the user moves the mouse body 11 to the desired position, the controller 81 applies the control signal to the clutch 45 to control the clutch 45 such that the second motor 41 is connected to the wheel 25 and applies the control signal to the second motor 41 to drive the second motor 41. Accordingly, the torque of the second motor 41 is transferred to the wheel 25 through the clutch 45, so that the user may perform the rehabilitation exercise in accordance with the pattern set by the program while the user puts their hands on the mouse body 11 regardless of the will of the user.

In the present embodiment, the controller 81 is disposed at the intermediate frame 21 of the mouse body 11, but it should not be limited thereto or thereby. That is, the controller 81 may be disposed at the upper frame 13 or the lower frame 17.

In addition, the mouse-type rehabilitation exercise device 10 according to an embodiment of the present invention may further include the handle 85 gripped by the user's hand.

The handle 85 has a substantially rod shape and is protruded upward from the upper frame 13 of the mouse body 11. The handle 85 may be provided to the mouse body 11 to be swivelable as a joystick and indicate the movement direction of the mouse body 11.

A plurality of elastic members 87, e.g., a plate-shaped spring, is disposed around the handle mounting hole 23 of the mouse body 11 to correspond to the movement in front, rear, left, and right sides of the handle 85. Accordingly, when the user takes his/her hand off the handle 85 after swiveling the handle 85 to one side, the handle 85 returns to its original state before being swiveled by an elastic force of the elastic members 87.

The controller 81 applies the control signal to the first motor 31 in response to an operation signal from the handle 85 to drive the first motor 31 and to align the position of the wheel 25, and thus the mouse body 11 moves to the direction indicated by the handle 85. In addition, when the direction of the wheel 25 is aligned, the controller 81 applies the control signal to the clutch 45 to control the clutch 45 such that the second motor 41 is selectively connected to the wheel 25, and the controller 81 applies the control signal to the second motor 41 to drive the second motor 41, thereby rotating the wheel 25.

As described above, the user may perform the rehabilitation exercise in the first operation mode or the second operation mode.

In addition, the controller 81 may control the mouse body 11 such that the mouse body 11 is operated in a third operation mode.

The third operation mode is a kind of resistant operation mode in which the mouse body 11 moves to a direction opposite to the direction indicated by the handle 85 on the basis of the operation signal from the handle 85.

In the third operation mode, the first motor 31 is driven to align the position of the wheel 25 on the basis of the operation signal from the handle 85, and the second motor 41 is connected to the wheel 25 by the clutch 45 to rotate the wheel 25 such that the mouse body 11 moves to the direction opposite to the direction indicated by the handle 85.

Accordingly, when the third operation mode is selected by the control selection button 89, the controller 81 applies the control signal to the first motor 31 to drive the first motor 31 and to align the position of the wheel 25 such that the mouse body 11 moves to the direction opposite to the direction indicated by the handle 85. Then, the controller 81 applies the control signal to the clutch 45 to control the clutch 45 such that the second motor 41 is connected to the wheel 25, and the controller 81 applies the control signal to the second motor 41 to drive the second motor 41 such that the torque of the second motor 41 is transferred to the wheel 25 through the clutch 45. Therefore, the wheel 25 is rotated to allow the mouse body 11 to move to the direction opposite to the direction indicated by the handle 85.

Thus, the user may apply a force to the mouse body 11 such that the mouse body 11 moves to the direction indicated by the handle 85 without moving to the direction opposite to the direction indicated by the handle 85. Consequently, a muscle strength of the user may be increased, and thus the user may perform the rehabilitation exercise.

Meanwhile, as another embodiment of the third operation mode, on the basis of the operation signal from the handle 85, the controller 81 drives the first motor 31 to align the position of the wheel 25 to the direction indicated by the handle 85 and connects the second motor 41 and the wheel 25 using the clutch 45 to rotate the wheel 25 such that the mouse body 11 moves to the direction opposite to the direction indicated by the handle 85.

Here, the handle 85 is provided in the handle mounting hole 23 of the mouse body 11 such that the handle 85 is not swiveled. Accordingly, the user may substantially simultaneously grip the handle 85 when placing the hands on the mouse body 11, and thus the user may perform the rehabilitation exercise while steadily placing the hands on the mouse body 11.

In addition, the mouse-type rehabilitation exercise device 10 according to an embodiment of the present invention further includes a pattern identifier 91.

The pattern identifier 91 is disposed on a lower surface of the lower frame 17 of the mouse body 11 to identify coordinate data of a printed pattern printed on a printed matter such as a sensing sheet (not shown) serving as a mouse pad. An optical identification sensor (OID sensor) or a photosensor that identifies the printed pattern printed on the printed matter, such as the sensing sheet, may be employed as the pattern identifier. Hereinafter, the optical identification sensor will be described in detail as the pattern identifier applied to the mouse-type rehabilitation exercise device 10.

The mouse-type rehabilitation exercise device 10 according to an embodiment of the present invention includes a first optical identification sensor 91 and a second optical identification sensor 93 as the pattern identifier, and the first and second identification sensors 91 and 93 are disposed on the lower surface of the lower frame 17 of the mouse body 11 to be spaced apart from each other.

Accordingly, the coordinate data with respect to one shape of a circular shape, an oval shape, a spiral shape, and a polygonal shape as an example of the printed pattern printed on the printed matter are identified through the first optical identification sensor 91 and the second optical identification sensor 93, and each of the first and second identification sensors 91 and 93 transmits the identified coordinate data to the controller 81. Meanwhile, since the first optical identification sensor 91 and the second optical identification sensor 93 are disposed spaced apart from each other, the controller 81 may identify a moving direction and a present position of the mouse body 11.

Meanwhile, when the control selection button 89 is operated such that the mouse body 11 moves along the pattern printed on the printed matter instead of moving by the above-mentioned first operation mode or the second operation mode, the first optical identification sensor 91 and the second optical identification sensor 93 identify the coordinate data of the printed pattern printed on the printed matter and transmit the coordinate data with respect to the identified printed pattern to the controller 81. Accordingly, the controller 81 controls the drive of the first motor 31, the second motor 41, and the clutch 45 to move the mouse body 11 on the basis of the coordinate data with respect to the printed pattern, which are provided from the first optical identification sensor 91 and the second optical identification sensor 93. As a result, the user may perform the rehabilitation exercise in accordance with the pattern printed on the printed matter while the user puts his/her hand on the mouse body 11 regardless of his/her will.

INDUSTRIAL APPLICABILITY

As described above, according to the present invention, the mouse body moves by aligning the position of the wheel using the first motor and rotating the wheel using the second motor. Accordingly, the device may be realized in compact form, and joint exercises are performed through various patterns in accordance with a user's characteristics to vary a joint angle of wrist and/or shoulder of the user for rehabilitation exercises.

In addition, since the handle in the form of the joystick is provided to the mouse body, the user may move the mouse body to the desired direction using the fine muscle strength while the joint angle of wrist and/or shoulder of the user is varied for rehabilitation exercises.

The invention claimed is:

1. A rehabilitation exercise device comprising:

a body configured to be mounted by a hand;

a wheel combined with the body and configured to move the body;

a first motor combined with the body and configured to align a position of the wheel such that the body moves to a desired direction;

a second motor combined with the body and configured to drive the wheel such that the wheel aligned by the first motor moves to a desired position;

a clutch disposed between the second motor and the wheel and configured to connect the second motor to the wheel in order to transmit a driving power of the second motor to the wheel;

a joystick handle protruded from the body and configured to be gripped by the hand to receive a user input; and a controller connected with the first motor, the second motor, and the clutch, and configured to control a driving of the first motor, the second motor, and the clutch, such that, in a first operation mode, the controller is configured to control only an alignment of the wheel to correspond to the desired direction according to the user input received via the joystick handle, without controlling driving of the wheel even though a pattern programmed in the rehabilitation exercise device includes information on the desired position, and in a second operation mode, the controller is configured to control the alignment of the wheel to correspond to the desired direction according to the user input received via the joystick handle and control the driving of the wheel to move the body to the desired position corresponding to the pattern programmed in the rehabilitation exercise device.

2. The rehabilitation exercise device of claim 1, wherein the controller controls the body such that the body is operated in the second operation mode when the body does not move to the desired position within a predetermined time period in the first operation mode.

3. The rehabilitation exercise device of claim 1, wherein the body comprises a plurality of casters disposed at the body to be capable of rolling, wherein the plurality of casters is configured to maintain a horizontal level of the body and change the direction of the body.

4. The rehabilitation exercise device of claim 1, wherein the body comprises:

a driving gear coupled to a shaft of the first motor;

a driven gear engaged with the driving gear; and a rotating bracket supported by the driven gear and provided to the body to be rotatable, and wherein the second motor is supported by one side portion of the rotating bracket, the wheel is supported by the other side portion of the rotating bracket to be capable of rolling such that the clutch is disposed between one side portion of the rotating bracket and the other side portion of the rotating bracket, and the rotating bracket is rotated by rotation of the driven gear.

5. The rehabilitation exercise device of claim 4, further comprising a weight supported by the rotating bracket to face the second motor such that the wheel and the clutch are disposed between the weight and the second motor and to maintain a center of gravity applied to the rotating bracket.

6. The rehabilitation exercise device of claim 1, wherein the handle is provided to the body to be swivelable.

7. The rehabilitation exercise device of claim 6, wherein the handle is connected with the controller, and the controller drives the first motor to align the position of the wheel, and selectively connects the wheel and the second motor by the clutch to rotate the wheel in response to an operation signal from the handle such that the body moves to a direction indicated by the handle.

8. The rehabilitation exercise device of claim 6, wherein the handle is connected with the controller, and the controller drives the first motor to align the position of the wheel and connects the second motor and the wheel by the clutch to rotate the wheel in response to an operation signal from the handle such that the body moves to a direction opposite to a direction indicated by the handle.

9. The rehabilitation exercise device of claim 6, wherein the handle is connected with the controller, and the controller drives the first motor to align the position of the wheel in a first direction indicated by the handle and connects the second motor and the wheel by the clutch to rotate the wheel in response to an operation signal from the handle such that the body moves to a second direction opposite to the first direction indicated by the handle.

10. The rehabilitation exercise device of claim 1, further comprising a pattern identifier disposed at the body and connected with the controller, the pattern identifier detects a printed pattern printed on a printed matter and identifies coordinate data of the detected printed pattern, wherein the controller is configured to control the drive of the first motor, the second motor, and the clutch such that the body moves on the basis of the identified coordinate data of the printed pattern.

11. The rehabilitation exercise device of claim 10, wherein the pattern identifier is an optical identification sensor or a photo-sensor.

* * * * *